United States Patent [19]

Peters

[11] 4,108,653

[45] Aug. 22, 1978

[54] PRESSURE-FIXABLE TONER POWDER WITH A THERMOPLASTIC POLYETHYLENE BINDER

[75] Inventor: Martinus T. J. Peters, Venlo, Netherlands

[73] Assignee: Oce-van der Grinten N.V., Venlo, Netherlands

[21] Appl. No.: 735,821

[22] Filed: Oct. 26, 1976

[30] Foreign Application Priority Data

Jul. 5, 1976 [NL] Netherlands ..... 7607380

[51] Int. Cl.[2] ..... G03G 13/20; G03G 9/00

[52] U.S. Cl. ..... 96/1 SD; 252/62.1 P; 427/22

[58] Field of Search ..... 96/1 SD; 252/62.1; 427/221, 22; 428/407

[56] References Cited

U.S. PATENT DOCUMENTS

| | | | |
|---|---|---|---|
| 3,788,994 | 1/1974 | Wellman et al. | 252/62.1 |
| 3,853,778 | 12/1974 | Buckley | 252/62.1 |
| 3,967,962 | 7/1976 | O'Malley | 252/62.1 |

*Primary Examiner*—Roland E. Martin, Jr.
*Assistant Examiner*—John L. Goodrow
*Attorney, Agent, or Firm*—Albert C. Johnston

[57] ABSTRACT

Polyethylene having an average molecular weight of at least 1,500, a crystallinity of at least 75% and a density of at least 0.93 has been found advantageous as a base material for making pressure-fixable toner powder for developing electrostatic images. The toner powder can be fixed satisfactorily to image substrates by the pressure of fixing rollers of conventional electrophotographic copying apparatus, yet it can be produced readily by grinding a suitable composition based on the polyethylene. The polyethylene preferably has an average weight of between 2,000 and 10,000, a crystallinity of at least 80% and a density of at least 0.94. Especially advantageous pressure-fixable, electrically conductive toner powders are obtained from pigmented masses of the polyethylene in which 3 to 20% of the weight consists of carbon black having a specific surface of at least 750 $m^2/g$, preferably of about 1,000 $m^2/g$, and an oil absorption of between 250 and 400 ml/g.

11 Claims, No Drawings

PRESSURE-FIXABLE TONER POWDER WITH A THERMOPLASTIC POLYETHYLENE BINDER

This invention relates to toner powder for developing electrostatic images, which toner powder can be affixed to a substrate by the application of pressure.

British patent specification No. 1,210,665 describes a pressure-fixable toner powder comprising colored or black thermoplastic particles which have a heat of fusion between 10 and 45 milli-calories per milligram and of which the binder material consists substantially of an aliphatic wax or waxy component having 6 to 57 carbon atoms, and, preferably 6 to 25 carbon atoms in its molecule. In addition to the aliphatic wax or waxy component the toner particles may contain a thermoplastic resin.

German patent application No. 2,431,200 describes a pressure-fixable toner powder which is relatively electrically conductive. This powder comprises thermoplastic particles containing from 50 to 100 parts by weight of wax or waxy component having a melting point between 45° and 150° C, from 2 to 50 parts by weight of thermoplastic resin having a softening point of at least 60° C and, optionally, ferromagnetic material. The particles have very fine electrically conductive particles, such as carbon particles, embedded in a radially disposed zone near the surface.

Due to the fact that waxy materials which form the chief ingredient of these known pressure-fixable toner powders are hardly grindable, these toner powders have the drawback that they are very difficult to prepare by the process preferred for toner preparation. This preferred process comprises melting the binder, or melting binders together, dissolving or finely dispersing the additives, such as dyestuff, pigment or ferromagnetic material, in the melt, cooling the melt to a solid mass and, finally, grinding the solid mass to particles of the desired size, which generally range between 1 and 65 micrometers. Grinding of a solid mass consisting substantially of waxy material can only occur with a very low yield unless, as described in Example 1 of German patent application No. 2,431,200, special arrangements are made, viz, for strongly cooling the solid mass prior to processing it in the grinder. However, in preparing toner powders on a large scale, it is disadvantageous to effect strong cooling of the solid mass before grinding it, because in that case large and costly cooling systems are necessary for carrying out this preparing step.

The principal object of the present invention is to provide a pressure-fixable toner powder which comprises an easily grindable binder as its main component and, consequently, can be readily prepared by grinding a solid mass.

The pressure-fixable toner powder according to the invention comprises particles which contain a polyethylene, a colorant selected from the group consisting of dyestuffs and pigments and, optionally, additives, and are characterized in that the polyethylene has a weight average molecular weight of at least 1,500, a crystallinity of at least 75%, and a density of at least 0.93.

Surprisingly it has been found that toner powders containing essentially this particular type of polyethylene as a binder are eminently fixable with the pressures usually employed in the fixing apparatus of electrophotographic copying apparatus, but that these toner powders can nevertheless be prepared by the preferred process with a high yield, by grinding them in the usual grinders, without requiring special arrangements for strongly cooling the solid mass. This result is surprising, because it was expectable that powders possessing the high pressure-sensitivity required for proper pressure-fixing properties would involve greater difficulties of grinding rather than otherwise.

Very good results in respect of grindability of the solid mass and pressure-fixability of the toner powder are obtained according to the present invention with polyethylene compounds having an average molecular weight between 2,000 and 10,000, a crystallinity of at least 80%, and a density of at least 0.94.

The crystallinity of the polyethylene employed according to the invention is determined by means of a DuPont Thermal Analyzer 990, in accordance with the method described in duPont Application Brief No. 12 of Jan. 15, 1968. The density of the polyethylene is determined at 23° C according to the method described in ASTM D1505—63T.

In addition to polyethylene of the type defined, the pressure-fixable toner powders according to the invention may contain other binders such as thermoplastic resin or waxy materials. However, in order to ensure proper grindability of the solid mass and/or easy pressure-fixability of the toner powder, the quantity of these other binders should not exceed 30 percent by weight of the entire amount of binder material. Preferably, the quantity of other binder material does not exceed 20 percent by weight. Examples of other binders that can be mixed with the polyethylene in relatively small quantities of no more than 30 percent by weight are: polystyrene, copolymers of styrene with an acrylate or methacrylate, polyvinyl chloride, polvinyl acetate, copolymers of vinyl acetate with vinyl chloride or of ethylene with vinyl acetate, polyester resins, polyamides and, in addition, waxy materials, for instance those mentioned in British patent specification No. 1,210,665 and German patent application No. 2,431,200.

As colorant, the toner powder according to the invention may contain any of the well known substances such as inorganic pigment, e.g., carbon black, chrome yellow, or organic dye or pigment.

The pressure-fixable toner powder according to the invention may be electrically insulating or may have so high an electrical conductivity that it can be deposited onto an electrostatic image by inductive attraction.

Generally, the insulating toner powders are blended with carrier particles against which the toner particles are charged triboelectrically in a polarity opposite to that of the electrostatic image to be developed. Besides the polyethylene as defined above, the colorant and, optionally, the aforementioned additives, the insulating toner powders may contain further additives such as, for example, a polarity control agent ensuring that the toner particles will acquire a charge of the correct polarity upon triboelectric charging against the carrier particles. The substances well known in the art can be used as polarity control agent, e.g., organic, basic dyes such as nigrosine, induline, crystal violet, salts of basic dyes with an organic acid as described, e.g., in German patent specification No. 1,929,851 and Belgian patent specification No. 806,408, quaternary ammonium compounds, and polymers carrying basic groups.

The polarity control agent may be present in the insulating toner particles in a finely distributed state, i.e., dissolved or very finely dispersed in the resin, or it may be deposited onto the surface of the toner particles as a thin layer in the conventional way. Generally, the quantity of the polarity control agent in the toner particles ranges between 0.1 and 8 percent by weight when it is finely distributed in the toner particles, and between 0.001 and 0.5 percent by weight, when it is deposited onto the surface of the toner particles. The quantity of colorant in the insulating toner powders may amount, for example, to approximately 10 percent by weight. Examples of carrier particles which may be mixed with the insulating toner partiles are: iron and nickel grains, sand, glass and quartz.

Toner powder according to the invention having so high an electrical conductivity that it can be deposited onto an electrostatic image by inductive attraction, can be obtained by finely distributing in the polyethylene resin a sufficient quantity of electrically conductive material such as carbon black, metal particles or electrically conductive donor-acceptor complexes, optionally in admixture with other additives, or by depositing electrically conductive material onto the surface of the polyethylene particles, which may contain additives, for example as described in German patent application No. 2,431,200 or Dutch patent application No. 7203523. The specific resistance of the electrically conductive toner powder must be between about $10^3$ and about $10^{13}$ ohm.cm., depending, inter alia, upon the developing method in which the toner is used.

A particularly advantageous electrically conductive pressure-fixable toner powder according to the invention is obtained when carbon black having a specific surface of at least 750 $m^2/g$ and an oil absorption of between 250 and 400 ml/g is finely dispersed in the polyethylene particles in an amount ranging between 3 and 20 percent by weight, depending on the specific resistance required in the toner powder. It has been found even that the grindability of the polyethylene is improved when such a carbon black, preferably one having a specific surface of about 1,000 $m^2/g$, is dispersed in the polyethylene according to the invention. This carbon black has an additional important advantage in that it needs be dispersed in the polyethylene in only relatively small quantities of between approximately 3 and 20 percent by weight in order to impart the desired electrical conductivity to the polyethylene. When using carbon black having a specific surface below 750 $m^2/g$, such as the commercial product Corax L which has often been employed hitherto, a quantity of between 20 and 45 per cent by weight is required for imparting the same electrical conductivity to the binder material.

In addition to conductive material, which generally serves also as the coloring material, the electrically conductive toner powders may contain ferromagnetic substances in order to make the powder suitable for use in so-called magnetic brush developing apparatus, or to increase the specific weight of the toner powder to make it better suited for use in the so-called powder bath developing method as described in French Pat. No. 1,220,262. To increase the specific weight of these toner powders fillers such as titanium dioxide and barium sulphate may be used in them instead of ferromagnetic materials. An especially desirable pressure-fixable toner powder is obtained according to the invention, for example, from a heavily pigmented mass of the specified polyethylene in which the pigment comprises a major proportion of titanium dioxide and a minor proportion, amounting to about 10 to 15 percent by weight, of a carbon black as aforesaid having a specific surface of the order of about 1,000 $m^2/g$.

The toner powders according to the invention may be blended with a flow promoting agent, such as a metal soap or hydrophobic silica, to improve their flow characteristics.

The choice of the particle size of the toner powder depends upon the developing method in which the toner powder is to be used. Generally, the particles will have sizes of less than 65 micrometers but more than 1 micrometer. Spherical or almost spherical particles are preferred for some uses. Such particles can be obtained by rounding the powder after it has been ground to the desired particle size, for instance as described in German patent application No. 2,431,200, or by stirring a dispersion of the powder for some time in a suitable carrier liquid at a temperature in the neighborhood of the glass transition temperature of the toner powder.

The images formed with toner powders according to the invention can be fixed on a substrate in the known pressure-fixing devices, which usually comprise two smooth metal squeezing rollers pressed together at a force of between 10 and 100 kg per linear cm. Generally, properly fixed images are already obtained when the squeezing rollers of the fixing device are pressed together by a force of between 20 and 50 kg per linear cm.

The practice of the invention is further illustrated by the following examples.

EXAMPLE 1

A powder mixture composed of 188 g of polyethylene having an average molecular weight of 3,000, a crystallinity of 82% and a density of 0.942, 188 g of magnetically attractable iron oxide particles having a particle size below 100 nanometers, and 24 g of carbon black having an average particle size of approximately 30 nanometers, a specific surface of approximately 1,000 $m^2/g$, and an oil absorption of 340 ml/g was extruded in a twin screw extruder at a mass temperature of 85° C. After cooling to room temperature the extrudate was ground into small lumps, which were then ground fine in an ultracentrifugal mill. The particles that had a size of between 10 and 45 micrometers were separated from the pulverized powder by sieving and, thus, 360 g of toner powder having a specific resistance of approximately $10^{10}$ ohm.cm. were obtained.

After the toner powder had been intimately blended with 0.52 g of hydrophobic silica, it was used for magnetic brush development of an electrostatic image formed in a photoconductive element as described in British patent specification No. 1,120,123. The powder image was transferred in an electric field to a sheet of receiving paper, and was fixed thereon by passing the paper through two hard steel rollers which were of 7 cm in diameter and were pressed together at a linear force of 40 kg per cm.

A good copy with an excellently fixed image was obtained.

EXAMPLE 2

A powder mixture composed of 525 g of polyethylene having an average molecular weight of 2,500, a crystallinity of approximately 92% and a density of 0.949, and 75 g of carbon black according to Example 1 was extruded in a twin screw extruder at a mass temperature of 75° C, after which the melt was cooled to room temperature and, in the way described in the foregoing example, the solid mass was ground fine and sieved. Particles having a size between 15 and 55 micrometers were thus isolated, giving 550 g of toner powder having a specific resistance of approximately $10^4$ ohm.cm.

After blending this toner powder with 2.5 g of hydrophobic silica, the powder was used for powder bath development of an electrostatic image formed on a commercially available photoconductive zinc oxide paper. The powder image was fixed in the way described in Example 1, with the exception that now a linear pressure of 30 kg per cm was applied. A properly fixed copy of good quality was obtained.

When a polyethylene having an average molecular weight of 22,000 and a density of 0.915 was used according to above-mentioned example, a solid mass that could not be ground fine in the ultracentrifugal mill or another grinder was obtained after extruding and cooling to room temperature.

EXAMPLE 3

740 g of polyethylene as used in Example 1 were melted, after which
60 g of lamp black having a specific surface of 20 $m^2/g$ and an oil absorption of 280 ml/g
were dispersed in the melt at 160° C.

The melt was cooled to room temperature, and the solid mass was ground and sieved in the way described in Example 1, resulting in particles having a particle size between 10 and 30 micrometers.

The powder obtained was stirred for 30 minutes in a solution containing:
0.3 g of nigrosine (C.I. 50415),
4,000 ml of ethanol and
4,000 ml of water,
and then sucked off and dried.
30 g of the toner powder thus obtained was blended with
970 g of rounded iron particles having a particle size between 60 and 150 micrometers.

The powder developer thus obtained was used for magnetic brush development of an electrostatic image formed on photoconductive zinc oxide paper. The developed image was fixed as described in the foregoing example. A properly fixed copy was obtained.

EXAMPLE 4

A toner powder was prepared in the same way as described in Example 2, but composed of
420 g of polyethylene according to Example 2, and
105 g of a copolymer of 72% ethylene with 28% vinyl acetate as binder material.

In this case also good results, almost equal to those of Example 2, were obtained.

EXAMPLE 5

A toner powder was prepared in the way described in Example 2, from a mixture containing:
500 g of polyethylene having an average molecular weight of 3,000, a crystallinity of 82% and a density of 0.942,
375 g of titanium dioxide and
125 g of carbon black having a particle size of approximately 30 nanometers, a specific surface of approximately 1,000 $m^2/g$ and an oil absorption of 340 ml/g.

The toner powder obtained had a particle size between 20 and 60 micrometers and a specific resistance of about $10^4$ ohm.cm.

After blending with 2.5 g of hydrophobic silica the toner powder was used in powder bath development of an electrostatic image formed on a commercially available photoconductive zinc oxide paper. The powder image was fixed as described in Example 2. A properly fixed copy of good quality was obtained.

What is claimed is:

1. Pressure-fixable toner powder comprising particles which consist essentially of thermoplastic binder having dispersed therein colorant and, optionally, additives, characterized in that said binder comprises predominantly, in an amount rendering said particles readily fixable to a receiving surface by pressure, a polyethylene having a weight average molecular weight of at least 1,500, a crystallinity of at least 75% and a density of at least 0.93.

2. Toner powder according to claim 1, said polyethylene having an average molecular weight between 2,000 and 10,000, a crystallinity of at least 80%, and a density of at least 0.94.

3. Toner powder according to claim 1, said polyethylene constituting at least 70 percent by weight of the entire binder content in the toner powder.

4. Toner powder according to claim 1, said particles containing carbon black having a specific surface of at least 750 $m^2/g$ and an oil absorption of between 250 and 400 ml/g.

5. Toner powder according to claim 3, said particles containing between 3 and 20 percent by weight of carbon black having a specific surface of at least 750 $m^2/g$ and an oil absorption of between 250 and 400 ml/g.

6. Toner powder comprising selectively sized particles, ground from a solid mass, consisting essentially of thermoplastic binder composed predominantly of a polyethylene having an average molecular weight of approximately 2,500 to 3,000, a crystallinity greater than 80% and a density of at least 0.94, and pigment dispersed in said binder.

7. Toner powder according to claim 6, said particles having on their surface fine particles of hydrophobic silica.

8. Process for forming fixed visible images comprising the steps of developing an electrostatic image with a toner powder, and fixing the resulting powder image on a substrate by applying pressure thereto, characterized in that said toner powder is a toner powder according to claim 1.

9. Process for forming fixed visible images comprising the steps of developing an electrostatic image with a toner powder, and fixing the resulting powder image on a substrate by applying pressure thereto, characterized in that said toner powder is a toner powder according to claim 5.

10. Process for forming fixed visible images comprising the steps of developing an electrostatic image with a toner powder , and fixing the resulting powder image on a substrate by applying pressure thereto, characterized in that said toner powder is a toner powder according to claim 6.

11. Toner powder according to claim 6, a major proportion of said pigment being titanium dioxide and a minor proportion thereof, amounting to about 10 to 15 percent of the weight of said particles, being carbon black having a specific surface of the order of about 1,000 $m^2/g$ and an oil absorption of between 250 and 400 ml/g.

* * * * *

Notice of Adverse Decision in Interference

In Interference No. 100,558, involving Patent No. 4,108,653, M.-T. J. Peters, PRESSURE-FIXABLE TONER POWDER WITH A THERMOPLASTIC POLYETHYLENE BINDER, final judgment adverse to the patentee was rendered Dec. 1, 1981, as to claims 1-11.

[*Official Gazette April 6, 1982.*]